US008535864B2

(12) United States Patent
Iwazaki et al.

(10) Patent No.: US 8,535,864 B2
(45) **Date of Patent: *Sep. 17, 2013**

(54) MAGENTA TONER, DEVELOPER, TONER CARTRIDGE, PROCESS CARTRIDGE, IMAGE FORMING APPARATUS, AND IMAGE FORMING METHOD

(75) Inventors: Eisuke Iwazaki, Kanagawa (JP); Yuki Takamiya, Kanagawa (JP); Satoshi Inoue, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 7 days.

This patent is subject to a terminal disclaimer.

(21) Appl. No.: 13/352,786

(22) Filed: Jan. 18, 2012

(65) Prior Publication Data

US 2013/0078564 A1 Mar. 28, 2013

(30) Foreign Application Priority Data

Sep. 22, 2011 (JP) ..... 2011-207874

(51) Int. Cl.
*G03G 9/08* (2006.01)

(52) U.S. Cl.
USPC ..... 430/107.1; 430/108.1; 430/108.21; 430/109.4

(58) Field of Classification Search
USPC ..... 430/107.1, 108.1, 108.21, 109.4; 399/252
See application file for complete search history.

(56) References Cited

U.S. PATENT DOCUMENTS

| | | | |
|---|---|---|---|
| 2005/0112492 | A1 | 5/2005 | Makino et al. |
| 2007/0048646 | A1 | 3/2007 | Sasaki et al. |
| 2008/0261141 | A1 | 10/2008 | Yasukawa et al. |
| 2009/0239171 | A1 | 9/2009 | Anno et al. |
| 2009/0239174 | A1 | 9/2009 | Inaba et al. |
| 2009/0245858 | A1 | 10/2009 | Mizutani et al. |

FOREIGN PATENT DOCUMENTS

| | | |
|---|---|---|
| JP | A-2002-341594 | 11/2002 |
| JP | A-2005-258394 | 9/2005 |
| JP | A-2006-313302 | 11/2006 |
| JP | A-2008-287239 | 11/2008 |
| JP | A-2009-204774 | 9/2009 |
| JP | A-2009-258681 | 11/2009 |
| JP | A-2009-300733 | 12/2009 |

OTHER PUBLICATIONS

May 31, 2013 Office Action issued in U.S. Appl. No. 13/224,969.
U.S. Appl. No. 13/224,969, filed Sep. 2, 2011.
U.S. Appl. No. 13/019,694, filed Feb. 2, 2011.
Oct. 5, 2012 Office Action issued in U.S. Appl. No. 13/224,969.
Oct. 4, 2012 Office Action issued in U.S. Appl. No. 13/019,694.

*Primary Examiner* — Mark A Chapman
(74) *Attorney, Agent, or Firm* — Oliff & Berridge, PLC

(57) ABSTRACT

A magenta toner including toner particles containing a colorant and a binder resin is provided. The colorant contains C.I. Pigment Red 122 and C.I. Pigment Yellow 180 and a mass ratio of the C.I. Pigment Red 122 and the C.I. Pigment Yellow 180 is in the range of 99:1 to 10000:1. The binder resin contains a polyester resin and a polyester resin having a repeating unit obtained from a Bisphenol A alkylene oxide adduct expressed by the following chemical formula is used as the polyester resin:

Chemical Formula 1 wherein m and n independently represent an integer of 2 to 4, and x and y independently represent a positive number.

19 Claims, 3 Drawing Sheets

MAGENTA TONER, DEVELOPER, TONER CARTRIDGE, PROCESS CARTRIDGE, IMAGE FORMING APPARATUS, AND IMAGE FORMING METHOD

CROSS-REFERENCE TO RELATED APPLICATIONS

This application is based on and claims priority under USC 119 from Japanese Patent Application No. 2011-207874 filed Sep. 22, 2011.

BACKGROUND

1. Technical Field

The present invention relates to a magenta toner, a developer, a toner cartridge, a process cartridge, an image forming apparatus, and an image forming method.

2. Related Art

As in an electrophotographic method, a method of visualizing image information through the processes of forming an electrostatic latent image and developing the electrostatic latent image is presently used in various fields. Through the use of this method, an image is formed by charging the entire surface of a photosensitive member (a latent image holding member), forming an electrostatic latent image on the surface of the photosensitive member with a laser beam corresponding to image information through the exposure, developing the electrostatic latent image with a developer containing a toner to form a toner image, and then transferring and fixing the toner image to the surface of a recording medium.

Toner used in the electrophotographic method is typically produced by molten kneading method. The molten kneading method includes melting and kneading a plastic resin with a pigment, a charge-controlling agent, a release agent, and a magnetic material, then cooling the kneaded materials, and pulverizing and classifying the kneaded materials.

SUMMARY

According to an aspect of the invention, there is provided a magenta toner including toner particles containing a colorant and a binder resin, wherein the colorant contains C.I. Pigment Red 122 and C.I. Pigment Yellow 180, and a mass ratio of the C.I. Pigment Red 122 and the C.I. Pigment Yellow 180 is in the range of 99:1 to 10000:1, the binder resin contains a polyester resin, and a polyester resin having a repeating unit obtained from a Bisphenol A alkylene oxide adduct expressed by the following chemical formula 1 is used as the polyester resin.

Chemical Formula 1

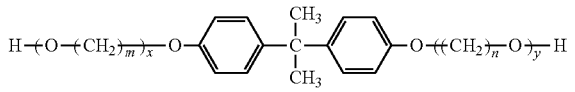

In the chemical formula, m and n independently represent an integer of from 2 to 4, and x and y independently represent a positive number.

BRIEF DESCRIPTION OF THE DRAWINGS

Exemplary embodiments of the present invention will be described in detail based on the following figures, wherein.

DETAILED DESCRIPTION

Figure 1:
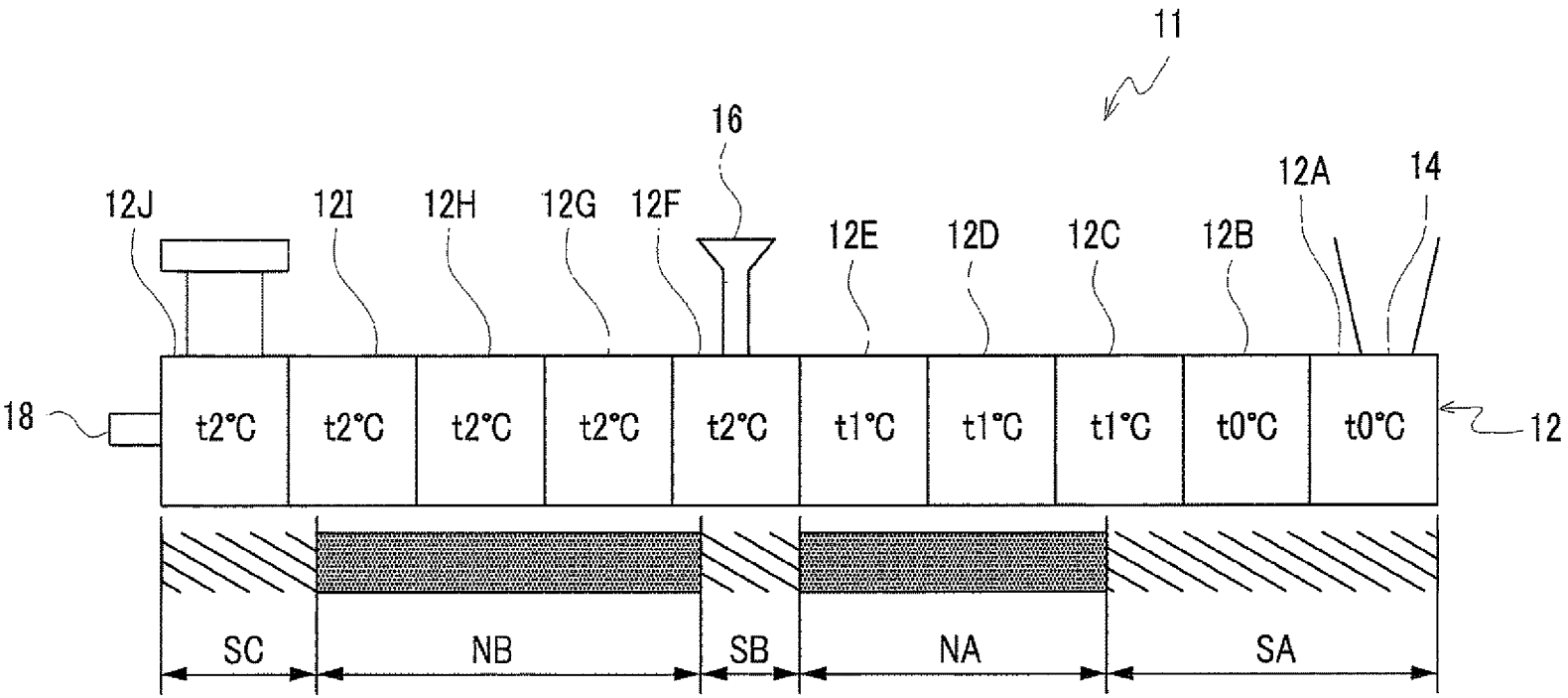
FIG. 1 is a diagram illustrating a screw condition in an example of a screw extruder used to produce a magenta toner according to an exemplary embodiment of the invention.

Hereinafter, a magenta toner, a developer, a toner cartridge, a process cartridge, an image forming apparatus, and an image forming method according to an exemplary embodiment of the invention will be described in detail.

Magenta Toner

A magenta toner according to an exemplary embodiment of the invention (hereinafter, also referred to as a toner according to this exemplary embodiment) includes toner particles including a colorant and a binder resin, the colorant includes C.I. Pigment Red 122 and C.I. Pigment Yellow 180, a mass ratio of the C.I. Pigment Red 122 and the C.I. Pigment Yellow 180 is in the range of 99:1 to 10000:1, the binder resin includes a polyester resin, and a polyester resin including a repeating unit obtained from a Bisphenol A alkylene oxide adduct expressed by the following chemical formula 1 is used as the polyester resin.

Chemical Formula 1

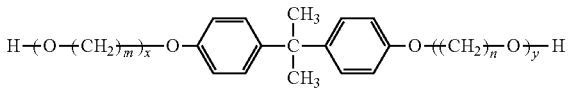

In the chemical formula 1, m and n independently represent an integer of 2 to 4, and x and y independently represent a positive number.

It is unclear that the reason for the suppression of a decrease in reproducibility of a red image in high humidity due to the use of the toner according to this exemplary embodiment, but we thought the reason is as follows.

The C.I. Pigment Red 122 is a pigment having high color reproducibility, but when the C.I. Pigment Red 122 is singly used as a colorant, the reproducibility of a red image may be low in repeated copying operations in high humidity. The reason is thought that by aggregating the C.I. Pigment Red 122 as a colorant in the toner, permeation of the toner into a recording medium is not stabilized when a toner image is fixed to the recording medium such as a sheet of paper, and moisture in the toner becomes bubbles during fixing in high humidity to cause unevenness on the surface of the fixed image and to lower the gloss of the toner image, and thus the reproducibility of a red image in high humidity is deteriorated.

Since the C.I. Pigment Red 122 often includes abietate having high viscosity for the purpose of dispersion, it is thought that the abietate on the surface of the pigment is melted to attach the pigment particles to each other and thus to aggregate the pigment particles during kneading the toner material in producing the toner, whereby the dispersibility of the pigment in the toner is lowered. Since the C.I. Pigment Red 122 can easily conjugate to molecules and easily form stable associates, it is thought that the particles of the C.I. Pigment Red 122 can easily aggregate. As a result, in the toner using the C.I. Pigment Red 122 exhibiting the above-mentioned properties as a colorant, it is thought that the initial image quality of repeated copying and the image quality after repeating 100 copies differ from each other.

The inventors find that by adding a small amount of C.I. Pigment Yellow 180 to the C.I. Pigment Red 122 and using a polyester resin having the repeating unit obtained from Bisphenol A alkylene oxide, it is possible to improve the dispersibility of the C.I. Pigment Red 122 and to suppress a decrease in reproducibility of a red image in high humidity during repeated copying.

That is, since the bulky molecules of the C.I. Pigment Yellow 180 are attached to abietate, it is thought that the apparent melting temperature of the colorant is raised and the aggregation due to the attachment of the pigment particles is suppressed. It is thought that an interaction acts between an ester group of the polyester resin including the repeating unit obtained from Bisphenol A alkylene oxide and a carbonyl group of the C.I. Pigment Red 122 to prevent the formation of associates of the pigment particles, whereby the aggregation of the particles of the C.I. Pigment Red 122 is suppressed. Since the aggregation of the particles of the C.I. Pigment Red 122 is suppressed, it is thought that the amount of pigment on the toner surface is decreased to lower the moisture absorbency of the toner and thus the moisture in the toner is decreased. As a result, it is thought that the pigment dispersibility in the toner having this configuration is improved and the moisture in the toner is decreased to suppress the formation of bubbles during fixing, whereby it is possible to suppress the decrease in reproducibility of a red image in high humidity during repeated copying.

In this exemplary embodiment, it is preferable that a toner including an azo-based or diazo-based pigment as a colorant is used as a yellow toner which is used along with the toner according to this exemplary embodiment when forming a red image.

The configuration of the toner according to this exemplary embodiment will be described below.

The toner according to this exemplary embodiment includes toner particles including a colorant and a binder resin and may include external additives if necessary.

Colorant

In this exemplary embodiment, C.I. Pigment Red 122 and C.I. Pigment Yellow 180 are together used as a colorant.

In this exemplary embodiment, the mass ratio of the C.I. Pigment Red 122 and the C.I. Pigment Yellow 180 is in the range of 99:1 to 10000:1. When the ratio of the C.I. Pigment Red 122 is smaller than 99:1, the color is shifted to yellow, thereby causing a problem in that the reproducibility of a red image is lowered. On the other hand, when the ratio of the C.I. Pigment Red 122 is greater than 10000:1, the particles of C.I. Pigment Red 122 can easily aggregate to reduce pigment dispersibility, thereby causing a problem in that the red reproducibility is lowered. The mass ratio of the C.I. Pigment Red 122 and the C.I. Pigment Yellow 180 is preferably in the range of 500:1 to 5000:1.

The total amount of the colorant included in the toner particles according to this exemplary embodiment is preferably in the range of 1 part by mass to 20 parts by mass with respect to 100 parts by mass of the binder resin.

In this exemplary embodiment, it is essential to use the C.I. Pigment Yellow 180. When yellow pigments other than the C.I. Pigment Yellow 180 are used, it may not be possible to suppress the aggregation of the C.I. Pigment Red particles, thereby causing a problem in that the reproducibility of a red image is lowered.

As a method of detecting the C.I. Pigment Yellow 180 and the C.I. Pigment Red 122 in the toner, toluene insoluble of the toner is first extracted and then the amount of the C.I. Pigment Yellow 180, the amount of the C.I. Pigment Red 122, and the ratio of the amount of the C.I. Pigment Red 122/the amount of the C.I. Pigment Yellow 180 can be calculated through the use of weight measurement, IR and fluorescent X-ray analysis, and NMR analysis.

The mass ratio of the C.I. Pigment Yellow 180 and the C.I. Pigment Red 122 may be measured through the use of the following method.

Ionization based on direct laser irradiation of THF insoluble of the toner is performed through the use of a laser desorption/ionization (LDI) method.

More specifically, 1 g of the toner is dissolved in THF and the dispersion is filtrated and residue is then dried. The residue is ground with a mortar, and the ground residue is suspended in a THF/MeOH (1/1) solution, whereby a sample is obtained.

Mass analysis is performed under the following analysis conditions using an MS part of Ion Trap GC-MS (POLARIS Q) made by Themo Fisher Scientific Inc. as a meter and using a direct sample introduction method.

Analysis Conditions

GC-MS: POLARIS Q
Ion Source Temp: 200° C.
Electron Energy: 70 eV
Emission Current: 250 μA
Mass Range: m/z 50-1000
Reagent Gas: Methane Direct Exposure Probe (DEP)

Rate: 20 mA (10 sec)-5 mA/sec-1000 mA (30 sec)
Mass of C.I. Pigment Yellow 180: 706
Mass of C.I. Pigment Red 122: 326

The pigment ratio is calculated from the peak ratio of these pigments.

Binder Resin

In the exemplary embodiment, a polyester resin including a repeating unit obtained from Bisphenol A alkylene oxide expressed by Chemical Formula 1 is used as the binder resin. The polyester resin can be obtained by polymerizing dicarboxylic acid and diol as polymerizable monomers. The Bisphenol A alkylene oxide expressed by Chemical Formula 1 is used as the diol component of the polyester resin.

In this exemplary embodiment, the "repeating unit obtained from Bisphenol A alkylene oxide expressed by Chemical Formula 1" means a constituent site of the polyester resin which is the Bisphenol A alkylene oxide expressed by Chemical Formula 1 before the polymerization.

When m and n in Chemical Formula 1 are 1, the hydrophilic property of the resin increases and the dispersibility of the colorant having a high hydrophobic property is lowered.

On the other hand, when m and n in Chemical Formula 1 are greater than 5, the chargeability of the toner can easily vary and thus it may be difficult to control the amount of toner attached in developing and transfer processes.

In Chemical Formula 1, m and n are preferably 3 or 4.

In this exemplary embodiment, when synthesizing the polyester resin, diols other than the Bisphenol A alkylene oxide expressed by Chemical Formula 1 may be used together. Examples of other diols include aliphatic diols such as ethylene glycol, diethylene glycol, triethylene glycol, propylene glycol, butane diol, hexane diol, neopentyl glycol, and glycerin; alicyclic diols such as cyclohexane diol, cyclohexane dimethanol, and hydrogen-added Bisphenol A; and aromatic diols such as proplylene oxide adducts of Bisphenol A.

In this exemplary embodiment, the ratio of the repeating unit obtained from the Bisphenol A alkylene oxide expressed by Chemical Formula 1 to the repeating unit obtained from the overall diols is preferably equal to or more than 10 mol %, more preferably equal to or more than 80 mol %, and still more preferably 100 mol %.

Examples of the dicarboxylic acid used in this exemplary embodiment include aromatic carboxylic acids such as terephthalic acid, isophthalic acid, phthalic anhydride, trimellitic anhydride, pyromellitic acid, and naphthalenedicarboxylic acid; aliphatic carboxylic acids such as maleic anhydride, fumaric acid, succinic acid, alkenylsuccinic anhydride, and adipic acid; and alicyclic carboxylic acids such as cyclohexane dicarboxylic acid. These poly-valent carboxylic acids may be used singly or in combination of two or more.

The polyester resin can be produced at a polymerization temperature of from 180° C. to 230° C. And the polycondensation is progressed with removing water or alcohol which is obtained as a by-product, and as may be necessary, it is reacted under reducing pressure.

When the polymerizable monomers such as dicarboxylic acid or diol are not dissolved or soluble at the reaction temperature, a solvent having a high boiling point may be added as a solubilizing agent to dissolve the polymerizable monomers. In this case, the polycondensation reaction is progressed while distilling the solubilizing agent. When a polymerizable monomer having poor solubility is present for the copolymerization reaction, the polymerizable monomer having poor solubility and an acid or alcohol to be polycondensed with the polymerizable monomer may be condensed and then may be polycondensed with the main component thereof.

Examples of a catalyst which can be used for producing the polyester resin include alkaline metal compounds of sodium, lithium, and the like; alkaline-earth metal compounds of magnesium, calcium, and the like; metal compounds of zinc, manganese, antimony, titanium, tin, zirconium, germanium, and the like; phosphite compounds; phosphate compounds; and amine compounds.

Specific examples thereof include compounds such as sodium acetate, sodium carbonate, lithium acetate, lithium carbonate, calcium acetate, calcium stearate, magnesium acetate, zinc acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, antimony triphenyl, antimony tributyl, tin formate, tin oxalate, tin tetraphenyl, dibutyltin dichloride, dibutyltin oxide, diphenyltin oxide, zirconium tetrabutoxide, zirconium naphthenate, zirconium carbonate, zirconium acetate, zirconium stearate, zirconium octoate, germanium oxide, triphenyl phosphite, tris(2,4-di-t-butylphenyl) phosphite, ethyltriphenylphosphonium bromide, triethylamine, and triphenylamine.

The glass transition temperature (Tg) of the polyester resin used in this exemplary embodiment is preferably in the range of from 35° C. to 50° C. When Tg is equal to or higher than 35° C., a problem may be prevented from occurring in storage stability of a toner or stability of a fixed image. When Tg is equal to or lower than 50° C., the fixing may be performed at a temperature lower than that in the related art.

Tg of the polyester resin is more preferably in the range of from 45° C. to 50° C.

The glass transition temperature of the polyester resin is measured as a peak temperature of an endothermic peak obtained through the use of differential scanning calorimetry (DSC).

The weight-average molecular weight of the polyester resin used in this exemplary embodiment is preferably in the range of from 5000 to 30000 and more preferably in the range of from 7000 to 20000.

The weight-average molecular weight is measured through the use of gel permeation chromatography (GPC). The measurement of the molecular weight through the use of the GPC is performed using GPC HLC-8120 made by Tosoh Corp. as a meter and using Column TSKgel SuperHM-M (15 cm) made by Tosoh Corp. and a THF solvent. The weight-average molecular weight is calculated from the measurement result using a molecular weight calibration curve prepared on the basis of a mono-disperse polystyrene standard sample.

In this exemplary embodiment, polyester resins other than the specified polyester resin, ethylene resins such as polyethylene or polypropylene, styrene resins including polystyrene, poly(α-methyl styrene), or the like as a main component, (meth)acryl resins including polymethyl (meth)acrylate, poly (meth)acrylonitrile, or the like as a main component, polyamide resins, polycarbonate resins, polyether resins, or combinations of these copolymerized resins may be used as the binder resin.

The total amount of the binder resin included in the toner particles according to this exemplary embodiment is preferably in the range of from 40 mass % to 95 mass % with respect to the total solid mass of the toner particles and more preferably in the range of from 60 mass % to 85 mass %.

Release Agent

In this exemplary embodiment, the toner particles may include a release agent. Specific examples of the release agent include low-molecular-weight polyolefins such as polyethylene, polypropylene, and polybutene; silicones having a softening point; fatty acid amides such as oleic amide, erucic amide, recinoleic amide, and stearic amide; vegetable waxes such as carnauba wax, rice wax, candelilla wax, tallow, and jojoba oil; animal waxes such as bees wax; mineral or petroleum waxes such as montan wax, ozokerite, ceresin, paraffin wax, micro-crystalline wax, and Fischer-Tropsch wax; ester waxes of higher fatty acid and higher alcohol such as stearyl stearate and behenyl behenate; ester waxes of high fatty acid and mono-valent or poly-valent lower alcohol such as butyl stearate, propyl oleate, glyceride monostearate, glyceride distearate, and pentaerythritol tetrabehenate; ester waxes including higher fatty acid and poly-valent alcohol polymer such as diethylene glycol monostearate, dipropylene glycol distearate, diglyceride distearate, and triglyceride tetrastearate; sorbitan higher fatty acid ester waxes such as sorbitan monostearate; and cholesterol higher fatty acid ester waxes such as cholesteryl stearate.

These release agents may be used singly or in combination of two or more thereof.

Among these, hydrocarbon wax is preferably used. By using the hydrocarbon wax as the release agent, it is possible to improve the reproducibility of a red image. Although the reason is not clear, it is thought that the difference in bleeding of the release agent becomes relatively small by using the hydrocarbon wax as the release agent and unevenness on the surface of a fixed image is reduced to improve the gloss of a toner image, whereby the reproducibility of a red image in high humidity is improved.

Among the hydrocarbon waxes, mineral waxes such as paraffin waxes, microcrystalline waxes, and Fischer-Tropsch waxes, petroleum waxes, and polyalkylene waxes as modified products thereof are more preferable, in terms of uniform bleeding to the surface of the fixed image during fixing and an appropriate thickness of the release agent layer. The hydrocarbon waxes are still more preferably paraffin waxes.

The amount of the release agent to be added is preferably in the range of from 1 mass % to 20 mass % with respect to the total solid mass of toner particles and more preferably in the range of from 5 mass % to 15 mass %.

Other Components

Components (particles) other than the binder resin and the colorant, such as an inner additive, a charge-controlling agent, organic particles, a lubricant, and an abrasive, may be added to the toner particles, depending on the purpose.

Magnetic powder may be used as the inner additive. The magnetic powder may be added when the toner is used as a magnetic toner. Materials magnetized in a magnetic field are used as the magnetic powder and examples thereof include metals such as ferrite, magnetite, reduced iron, cobalt, manganese, and nickel, alloys thereof, and compounds including the metals.

The charge-controlling agent is not particularly limited but is preferably achromatic or light-color. Examples thereof include quarternary ammonium salt compounds, nigrosine compounds, dyes constituted of a complex of aluminum, iron, chromium, or the like and triphenylmethane pigments.

Examples of the organic particles include all kinds of particles typically used as external additives to the toner surface, such as vinyl resins, polyester resins, and silicone resins. The organic particles may be used as a fluidizing agent and a cleaning agent.

Examples of the lubricant include fatty acid amides such as ethylene bisstearic amide and oleic amide and fatty acid metal salts such as zinc stearate and calcium stearate.

Examples of the abrasive include silica, alumina, and cerium oxide.

The content of the other components has only to be an extent not to hinder the advantages of this exemplary embodiment and is generally very small. Specifically, the content of the other components is preferably in the range of from 0.01 mass % to 5 mass % with respect to the total solid mass of the toner particles and more preferably in the range of from 0.5 mass % to 2 mass %.

External Additive

The toner according to this exemplary embodiment may include an external additive.

Examples of the external additive include silica, alumina, titanium oxide, barium titanate, magnesium titanate, calcium titanate, strontium titanate, zinc oxide, silica sand, clay, mica, wollastonite, diatomaceous earth, cerium chloride, red iron oxide, chromium oxide, cerium oxide, antimony trioxide, magnesium oxide, zirconium oxide, silicon carbide, and silicon nitride. Among these, silica particles and titanium dioxide particles are preferable and hydrophobized silica particles and titanium dioxide particles are particularly preferable.

Methods known in the related are used for surface modification such as hydrophobization. Specific examples thereof include coupling processes of silane, titanate, aluminate, and the like. The coupling agent used for the coupling processes is not particularly limited, but preferable examples thereof include silane coupling agents such as methyl trimethoxysilane, phenyl trimethoxysilane, methylphenyl dimethoxysilane, diphenyl dimethoxysilane, vinyl trimethoxysilane, γ-aminopropyl trimethoxysilane, γ-chloropropyl trimethoxysilane, γ-bromopropyl trimethoxysilane, γ-glycidoxypropyl trimethoxysilane, γ-mercaptopropyl trimethoxysilane, γ-ureidepropyl trimethoxysilane, fluoroalkyl trimethoxysilane, and hexamethyl disilazane; titanate coupling agents; and aluminate coupling agents.

Various additives may be externally added if necessary. Examples of the additives include other fluidizers, cleaning agents such as polystyrene particles, polymethyl methacrylate particles, and vinylidene polyfluoride particles, and abrasives for removing attachments of a photosensitive member, such as zinc stearic amide and strontium titanate.

The amount of the external additive added is preferably in the range of from 0.1 part by mass to 5 parts by mass with respect to 100 parts by mass of the toner particles and more preferably in the range of from 0.3 part by mass to 2 parts by mass. When the added amount is equal to or more than 0.1 parts by mass, the fluidity of the toner is obtained. On the other hand, when the added amount is equal to or less than 5 parts by mass, occurrence of secondary damage due to migration of surplus inorganic oxide to a contact member by excessive coating is suppressed.

Characteristics of Toner

The shape factor SF1 of the toner according to this exemplary embodiment is preferably in the range of from 140 to 160 (or from about 140 to about 160). By setting the shape factor SF1 of the toner to the above-mentioned range, the reproducibility of a red image in high humidity is improved. Although the reason is not clear, it is thought that the shape of the toner is amorphous by setting the shape factor SF1 of the toner to the above-mentioned range. In addition, since red is a secondary color in forming an image during transferring, two toner layers and an image are raised but the rolling of the toner is suppressed to make it difficult to scatter the toner. Accordingly, the unevenness on the surface of the fixed image is reduced and the gloss of the toner image is improved, whereby the reproducibility of a red image in high humidity is improved.

The shape factor SF1 is more preferably in the range of from 145 to 155.

The shape factor SF1 is calculated by Expression 2.

$$SF1=(ML^2/A)\times(\pi/4)\times 100 \quad (2)$$

In Expression 2, ML represents the absolute maximum length of the toner particles and A represents the projection area of the toner particles.

SF1 is numerically expressed by analyzing a microscope image or a scanning electron microscope (SEM) image through the use of an image analyzer and is calculated as follows. That is, SF1 can be obtained by inputting an optical microscope image of particles scattered on the surface of a glass slide to a LUZEX image analyzer through the use of a video camera, calculating the maximum length and the projection area of 100 particles, solving Expression 2, and averaging the calculated values.

The volume-average particle diameter of the toner according to this exemplary embodiment is preferably in the range of from 8 μm to 15 μm (or from about 8 μm to about 15 μm), more preferably in the range of from 9 μm to 14 μm, and still more preferably in the range of from 10 μm to 12 μm. By setting the volume-average particle diameter of the toner to the above-mentioned range, the reproducibility of a red image in high humidity is improved. Although the reason is not clear, it is thought that red is a secondary color in forming an image during transferring and thus two toner layers and an image are raised, but the particle diameter hardly collapses and the rolling of the toner is suppressed to make it difficult to scatter the toner, by setting the volume-average particle diameter of the toner to the above-mentioned range. Accordingly, the unevenness on the surface of the fixed image is reduced and the gloss of the toner image is improved, whereby the reproducibility of a red image in high humidity is improved.

The volume-average particle diameter is measured by the use of Coulter Multisizer (made by Coulter Inc.) with an aperture diameter of 100 μm. Here, the measurement is performed after dispersing the toner in an aqueous electrolyte solution (Isoton aqueous solution) by ultrasonic waves for 30 seconds or more.

The glass transition temperature (Tg) of the toner according to this exemplary embodiment is preferably in the range of from 35° C. to 50° C. (or from about 35° C. to about 50° C.). When the glass transition temperature (Tg) of the toner is in the above-mentioned range, the reproducibility of a red image in high humidity is improved. Although the reason is not clear, it is thought that the bleeding of the release agent is uniform by setting the glass transition temperature (Tg) of the toner to the above-mentioned range and the unevenness on the surface of a fixed image is reduced to improve the gloss of the toner image, whereby the reproducibility of a red image in high humidity is improved.

The glass transition temperature (Tg) of the toner is more preferably in the range of from 40° C. to 50° C.

The glass transition temperature (Tg) is a value obtained through the use of measurement based on JIS 7121-1987 using a differential scanning calorimeter (DSC 3110, Thermal Analysis System 001, made by Mac Science Co., Ltd.). The melting point of a mixture of indium and zinc is used to correct the temperature of a detection unit of the apparatus and the melting heat of indium is used to correct the amount of heat. A sample (toner) is placed into an aluminum pan, the aluminum pan containing the sample and an empty aluminum pan for reference are set, and the temperature is measured at a temperature-rising rate of 10° C./min. The temperature of an intersection of extensions of a baseline in an endothermic part of the DSC curve obtained by the measurement and a start line is used as the glass transition temperature.

Method of Producing Toner

A method of producing the toner according to this exemplary embodiment is not particularly limited. Toner particles may be produced through the use of a dry method such as a known kneading and pulverizing method, a wet method such as an emulsification and aggregation method and a suspension and polymerization method, or the like and an external additive may be externally added to the toner particles if necessary. Among these methods, the kneading and pulverizing method is preferable.

The kneading and pulverizing method is a method of producing toner particles by kneading a toner-forming material including a colorant and a binder resin to acquire a kneaded material and then pulverizing the kneaded material. By producing the toner particles using the kneading and pulverizing method and obtaining the toner, the reproducibility of a red image in high humidity is improved. Although the reason is not clear, it is thought that since the toner is hydrophobic and thus does not absorb moisture even in high humidity to suppress the generation of bubbles due to moisture during fixing by producing the toner particles using the kneading and pulverizing method and obtaining the toner, the unevenness on the surface of a fixed image is reduced to improve the gloss of the toner image, whereby the reproducibility of a red image in high humidity is improved.

The kneading and pulverizing method may be divided into a kneading process of kneading a toner-forming material including a colorant and a binder resin and a pulverizing process of pulverizing the kneaded material. The kneading and pulverizing method may further include other processes such as a cooling process of cooling the kneaded material formed through the kneading process if necessary.

The processes will be described in detail below.

Kneading Process

In the kneading process, a toner-forming material including a colorant and a binder resin is kneaded.

In the kneading process, from 0.5 part by mass to 5 parts by mass of an aqueous medium (for example, water such as distilled water or ionized water and alcohols) is preferably added to 100 parts by mass of the toner-forming material.

Examples of a kneader used in the kneading process include a mono-axial extruder and a biaxial extruder. A kneader including a feed screw part and two kneading parts will be described below as an example of the kneader with reference to the accompanying drawing, but the kneader is not limited to this example.

FIG. 1 is a diagram illustrating a screw condition in an example of a screw extruder used in the kneading process of the method of producing a toner according to this exemplary embodiment.

A screw extruder 11 includes a barrel 12 including a screw (not shown), an injection port 14 used to inject the toner-forming material as a raw material of the toner into the barrel 12, a liquid adding port 16 used to add an aqueous medium to the toner-forming material in the barrel 12, and a discharge port 18 used to discharge a kneaded material formed by kneading the toner-forming material from the barrel 12.

The barrel 12 includes, sequentially from the closest to the injection port 14, a feed screw part SA feeding the toner-forming material injected from the injection port 14 to a kneading part NA, a kneading part NA melting and kneading the toner-forming material through a first kneading process, a feed screw part SB feeding the toner-forming material melted and kneaded in the kneading part NA to a kneading part NB, a kneading part NB melting and kneading the toner-forming material through a second kneading process to form a kneaded material, and a feed screw part SC feeding the formed kneaded material to the discharge part 18.

Temperature controllers (not shown) different depending on blocks are disposed in the barrel 12. That is, blocks 12A to 12J can be controlled at different temperatures. In FIG. 1, the temperatures of block 12A and block 12B are controlled into t0° C., the temperatures of blocks 12C to 12E are controlled into t1° C., and the temperatures of blocks 12F to 12J are controlled to t2° C. Accordingly, the toner-forming material in the kneading part NA is heated to t1° C. and the toner-forming material in the kneading part NB is heated to t2° C.

When the toner-forming material including a binder resin, a colorant, and a release agent as needed is supplied to the barrel 12 from the injection port 14, the toner-forming material is fed to the kneading part NA by the feed screw part SA. At this time, since the temperature of block 12C is set to t1° C., the toner-forming material is fed to the kneading part NA in a state where it is heated and melted. Since the temperatures of block 12D and block 12E are set to t1° C., the toner-forming material in the kneading part NA is melted and kneaded at the temperature of t1° C. The binder resin and the release agent are melted in the kneading part NA and are sheared by the screw.

Then, the toner-forming material having been subjected to the kneading in the kneading part NA is sent to the kneading part NB by the feed screw part SB.

In the feed screw part SB, an aqueous medium is added to the toner-forming material by injecting the aqueous medium into the barrel 12 from the liquid adding port 16. FIG. 1 shows a state where the aqueous medium is injected into the feed screw part SB, but the injection position is not limited to this example. The aqueous medium may be injected into the kneading unit NB or the aqueous medium may be injected into both the feed screw part SB and the kneading part NB. That is, the positions and the number of injection positions at which the aqueous medium is injected is selected as needed.

As described above, by injecting the aqueous medium into the barrel 12 from the liquid adding port 16, the toner-forming material and the aqueous medium are mixed in the barrel 12, the toner-forming material is cooled by latent heat of vaporization of the aqueous medium and thus the toner-forming material is maintained at an appropriate temperature.

Finally, the kneaded material formed by melting and kneading the toner-forming material through the use of the kneading part NB is fed to the discharge port 18 by the feed screw part SC and is discharged from the discharge port 18.

In this way, the kneading process using the screw extruder 11 shown in FIG. 1 is performed.

Cooling Process

The cooling process is a process of cooling the kneaded material formed through the kneading process. In the cooling process, it is preferable that the kneaded material is cooled from the temperature of the kneaded material at the end of the kneading process to 40° C. at an average temperature-falling rate of 4° C./sec or higher. When the cooling speed of the kneaded material is low, mixtures (mixtures of the colorant and intermediate additives such as the release agent added to the toner particles as needed) finely dispersed in the binder resin in the kneading process may be re-crystallized and the dispersion diameter may increase. On the other hand, when the kneaded material is rapidly cooled at the average temperature-falling rate, the dispersed state just after end of the kneading process is maintained without any change, which is preferable. The average temperature-falling rate means the average value of rates at which the temperature (t2° C., for example, when the screw extruder 11 shown in FIG. 1 is used) of the kneaded material at the end of the kneading process falls to 40° C.

A specific example of the cooling method in the cooling process is a method using a mill roll and an insertion type cooling belt which circulate in cool water or brine. When the cooling is performed using this method, the cooling rate is determined depending on the speed of the mill roll, the flow rate of brine, the amount of kneaded material supplied, the thickness of a slab during rolling the kneaded material, and the like. The thickness of the slab is preferably in the range of from 1 mm to 3 mm.

Pulverizing Process

The kneaded material cooled through the cooling process is pulverized in the pulverizing process to form particles. In the pulverizing process, for example, a mechanical pulverizer or a jet mill, are used.

Classification Process

The particles obtained through the pulverizing process may be classified through the classification process to obtain toner particles with a volume-average particle diameter in a target range. In the classification process, a centrifugal classifier, an inertial classifier, or the like used in the related art is used to remove fine grains (particles having a diameter smaller than a target range) and coarse grains (particles having a diameter larger than a target range).

External Additive Addition Process

For the purpose of charge control, fluidity, charge exchange, and the like, inorganic particles such as the specific silica, titanium dioxide, and aluminum oxide may be added and attached to the obtained toner particles. These particles are attached step by step, for example, through the use of a V-shaped blender, a Henschel mixer, or a Loedige mixer.

Sieving Process

After the external addition process, a sieving process may be provided if necessary. In the sieving method, specifically, a gyro shifter, a vibration sieving machine, a wind sieving machine, or the like can be used. By performing the sieving process, coarse grains of the external additive or the like are removed and thus the occurrence of a stripe on a photosensitive member and the contamination of the apparatus are suppressed.

Developer

A developer according to this exemplary embodiment includes at least the toner according to this exemplary embodiment.

The toner according to this exemplary embodiment may be used as a single-component developer or a two-component developer without any change. When the toner is used as the two-component developer, the toner is mixed with a carrier for use.

The carrier used for the two-component developer is not particularly limited, and known carriers may be used. Examples thereof include magnetic metals such as iron oxide, nickel, and cobalt, magnetic oxides such as ferrite and magnetite, resin-coated carriers having a resin coating layer on the surface of the core, and a magnetic-dispersed carrier. A resin-dispersed carrier in which a conductive material is dispersed in a matrix resin may be used.

In the two-component developer, the mixing ratio (mass ratio) of the toner and the carrier is preferably in the range of toner:carrier=1:100 to 30:100 and more preferably in the range of 3:100 to 20:100.

Image Forming Apparatus and Image Forming Method

An image forming apparatus according to this exemplary embodiment using the developer according to this exemplary embodiment will be described below.

The image forming apparatus according to this exemplary embodiment includes a latent image holding member, a charging unit that charges the surface of the latent image holding member, an electrostatic latent image forming unit that forms an electrostatic latent image on the surface of the latent image holding member, a developing unit that develops the electrostatic latent image with the developer according to this exemplary embodiment to form a toner image, and a transfer unit that transfers the toner image to a recording medium. The image forming apparatus may further include a fixing unit that fixes the toner image to the recording medium.

In the image forming apparatus, for example, a part including the developing unit may have a cartridge structure (process cartridge) that is detachable from the image forming apparatus. A process cartridge according to this exemplary embodiment that includes the developing unit containing the developer according to this exemplary embodiment and developing an electrostatic latent image formed on the surface of the latent image holding member with the developer to form a toner image and that is detachable from the image forming apparatus can be suitably used as the process cartridge.

An example of the image forming apparatus according to this exemplary embodiment will be described below, but this exemplary embodiment is not limited to the example. Main parts shown in the drawing will be described and the other parts will not be described.

Figure 2:
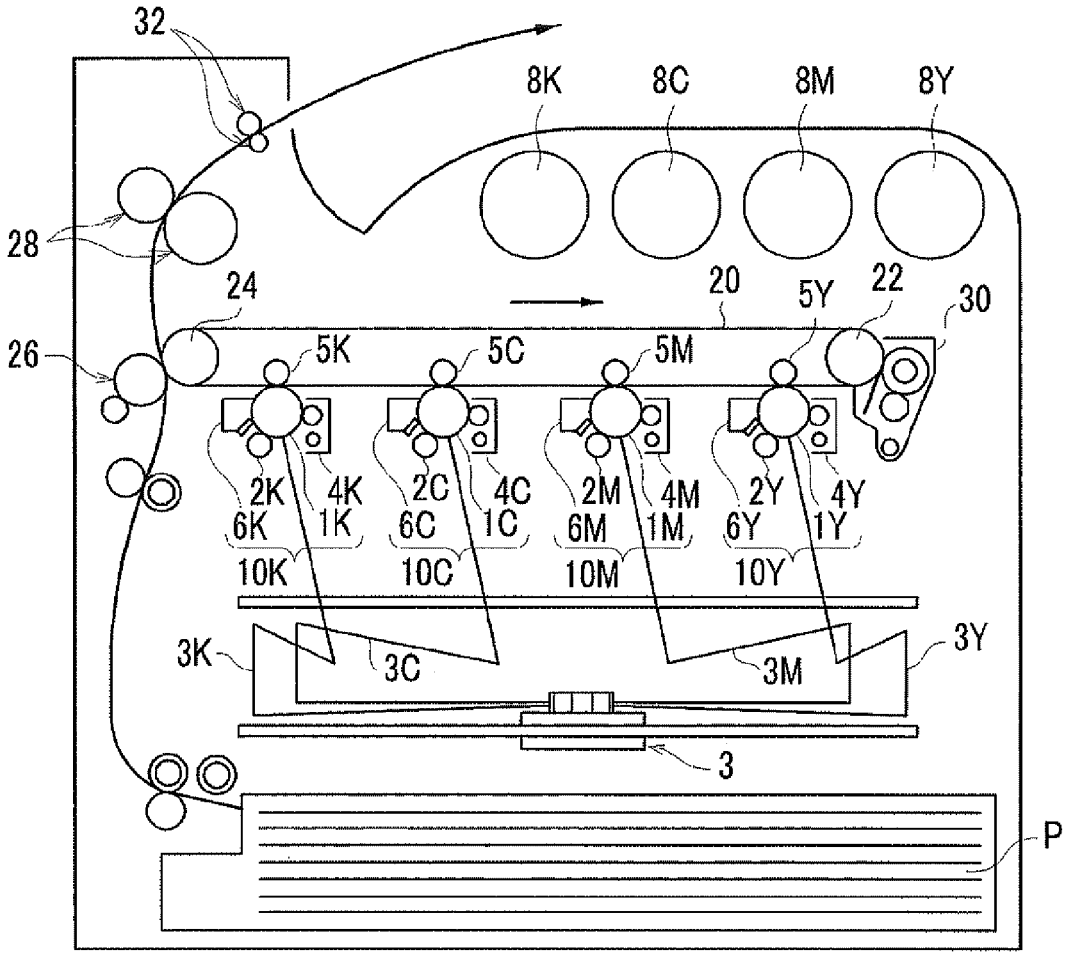
FIG. 2 is a diagram schematically illustrating the configuration of an image forming apparatus according to the exemplary embodiment of the invention.

FIG. 2 is a diagram schematically illustrating a four tandem type color image forming apparatus. The image forming apparatus shown in FIG. 2 includes first to fourth image forming units 10Y, 10M, 10C, and 10K (the image forming unit) of an electrophotographic type outputting color images of yellow (Y), magenta (M), cyan (C), and black (K) based on color-separated image data. The image forming units (hereinafter, also simply referred to as "units") 10Y, 10M, 10C, and 10K are arranged at a predetermined interval in the horizontal direction. The units 10Y, 10M, 10C, and 10K may be a process cartridge that is detachable from an image forming apparatus body.

Above the units 10Y, 10M, 10C, and 10K in the drawing, an intermediate transfer belt 20 as the intermediate transfer member extends over the units. The intermediate transfer belt 20 are wound on a driving roller 22 and a support roller 24 coming in contact with the inner surface of the intermediate transfer belt 20 and travels in the direction from the first unit 10Y to the fourth unit 10K. The support roller 24 is pushed in a direction in which it gets apart from the driving roller 22 by a spring not shown or the like and thus a predetermined tension is given to the intermediate transfer belt 20 wound on both. An intermediate transfer member cleaning device 30 is disposed on the surface of the intermediate transfer belt 20 facing the latent image holding member so as to face the driving roller 22.

The developing devices (the developing units) 4Y, 4M, 4C, and 4K of the units 10Y, 10M, 10C, and 10K can be supplied with four color toners of yellow, magenta, cyan, and black contained in the toner cartridges 8Y, 8M, 8C, and 8K, respectively. The toner according to this exemplary embodiment is used as the magenta toner.

Since the first to fourth units 10Y, 10M, 10C, and 10K have the same configuration, the first unit 10Y disposed upstream in the traveling direction of the intermediate transfer belt so as to form a yellow image will be representatively described below. The parts equivalent to those of the first unit 10Y are referenced by reference signs corresponding to magenta (M), cyan (C), and black (K) instead of yellow (Y), and the second to fourth units 10M, 10C, and 10K will not be described.

The first unit 10Y includes a photosensitive member 1Y as the latent image holding member. A charging roller 2Y charging the surface of the photosensitive member 1Y to a predetermined potential, an exposing device 3 exposing the charged surface with a laser beam 3Y based on a color-separated image signal to form an electrostatic latent image, a developing device (the developing unit) 4Y supplying a charged toner to the electrostatic latent image to develop the electrostatic latent image, a primary transfer roller (the primary transfer unit) 5Y transferring the developed toner image to the intermediate transfer belt 20, and a photosensitive member cleaning device (the cleaning unit) 6Y removing the toner remaining on the surface of the photosensitive member 1Y after the primary transfer are sequentially arranged around the photosensitive member 1Y.

The primary transfer roller 5Y is disposed inside the intermediate transfer belt 20 and is located at a position facing the photosensitive member 1Y. The primary transfer rollers 5Y, 5M, 5C, and 5K are connected to bias power sources (not shown) applying a primary transfer bias. The bias power sources vary the transfer bias to be applied to the primary transfer rollers under the control of a control unit not shown.

The operation of forming a yellow image by the use of the first unit 10Y will be described below. Before starting the operation, the surface of the photosensitive member 1Y is charged to a potential of −600 V to −800 V by the charging roller 2Y.

The photosensitive member 1Y has a structure in which a photosensitive layer is stacked on a conductive base (with volume resistivity of $1\times10^{-6}$ Ω·cm or less at 20° C.). The photosensitive layer has a characteristic that the resistance is normally high (which is the resistance of a normal resin) but the resistivity of a part irradiated with a laser beam is changed when the laser beam 3Y is applied thereto. The exposing device 3 outputs the laser beam 3Y to the charged surface of the photosensitive member 1Y on the basis of yellow image data sent from the control unit not shown. The laser beam 3Y is applied to the photosensitive layer on the surface of the photosensitive member 1Y and thus an electrostatic latent image of a yellow print pattern is formed on the surface of the photosensitive member 1Y.

The electrostatic latent image is an image to be formed on the surface of the photosensitive member 1Y by the charging and is a so-called negative latent image which is formed by lowering the resistivity of the irradiated part of the photosensitive layer with the laser beam 3Y to cause charges to flow on the surface of the photosensitive member 1Y and causing the charges to remain in the part not irradiated with the laser beam 3Y.

The electrostatic latent image formed on the photosensitive member 1Y in this way is transported to a predetermined developing position with the rotating of the photosensitive member 1Y. At the developing position, the electrostatic latent image on the photosensitive member 1Y is visualized (changed to a developed image) by the developing device 4Y.

The yellow developer contained in the developing device 4Y is frictionally charged by agitation in the developing device 4Y and is supported on a developer roller (the developer holding member) with charges having the same polarity (negative (−) polarity) as that of the charges on the photosensitive member 1Y. By causing the surface of the photosensitive member 1Y to pass through the developing device 4Y, the yellow toner is electrostatically attached to a latent image part on the surface of the photosensitive member 1Y to develop the latent image with the yellow toner. The photosensitive member 1Y having a yellow toner image formed thereon continuously rotates at a predetermined speed to carry the developed toner image on the photosensitive member 1Y to a predetermined primary transfer position.

When the yellow toner image on the photosensitive member 1Y is transported to the primary transfer position, a predetermined primary transfer bias is applied to the primary transfer roller 5Y and an electrostatic force acting from the photosensitive member 1Y to the primary transfer roller 5Y is applied to the toner image, whereby the toner image on the photosensitive member 1Y is transferred to the intermediate transfer belt 20. The transfer bias applied at this time has the (+) polarity opposite to the polarity (−) of the toner and is controlled to about +10 μA in the first unit 10Y by the control unit (not shown).

On the other hand, the toner remaining on the photosensitive member 1Y is removed and collected by the photosensitive member cleaning device 6Y.

The primary transfer biases applied to the primary transfer rollers 5M, 5C, and 5K of the second unit 10M and the subsequent units thereof are controlled similarly to the first unit.

In this way, the intermediate transfer belt 20 to which the yellow toner image is transferred in the first unit 10Y is sequentially transported through the second to fourth units 10M, 10C, and 10K and the toner images of the colors are superimposed to form a superimposed toner image.

The intermediate transfer belt 20 to which four color toner images are multiply transferred by the first to fourth units reaches a secondary transfer part formed by the intermediate transfer belt 20, the support roller 24 in contact with the inner surface of the intermediate transfer belt 20, and a secondary transfer roller (the secondary transfer unit) 26 disposed on the image supporting surface of the intermediate transfer belt 20. On the other hand, a recording sheet (the recording medium)

P is fed to a nip in which the secondary transfer roller 26 and the intermediate transfer belt 20 come in pressing contact with each other at a predetermined time by the use of a feed mechanism and a predetermined secondary transfer bias is applied to the support roller 24. The transfer bias applied at this time has the same (−) polarity as the polarity (−) of the toner and an electrostatic force acting from the intermediate transfer belt 20 to the recording sheet P is applied to the superimposed toner image, whereby the superimposed toner image on the intermediate transfer belt 20 is transferred to the recording sheet P. In addition, the secondary transfer bias is determined depending on the resistance detected by a resistance detector (not shown) detecting the resistance of the second transfer part and is voltage-controlled.

Thereafter, the recording sheet P is fed to the fixing device (the fixing unit) 28, and the superimposed toner image is heated to melt the color-superimposed toner image and is fixed to the recording sheet P. The recording sheet P to which the color image is fixed is transported by a transport roll 32 (discharge roll) to a discharge unit and a series of color image forming operations are ended.

The image forming apparatus has the configuration in which a superimposed toner image is transferred to a recording sheet P via the intermediate transfer belt 20, but is not limited to this configuration. The image forming apparatus may have a configuration in which a toner image is transferred directly to a recording sheet from the photosensitive member.

In the color image forming apparatus shown in FIG. 2, an image forming method is performed which includes a charging process of charging the surface of an image holding member, an electrostatic latent image forming process of forming an electrostatic latent image on the surface of the image holding member, a developing process of developing the electrostatic latent image formed on the surface of the image holding member with the developer according to this exemplary embodiment to form a toner image, a transfer process of transferring developed toner image to a transfer medium (a recording medium), and a fixing process of fixing the superimposed toner image to the recording medium to form an image. In this case, the image forming method according to this exemplary embodiment is performed by using the toner according to this exemplary embodiment as the magenta toner and using a yellow toner including as a colorant an azo or diazo pigment.

Process Cartridge and Toner Cartridge

Figure 3:
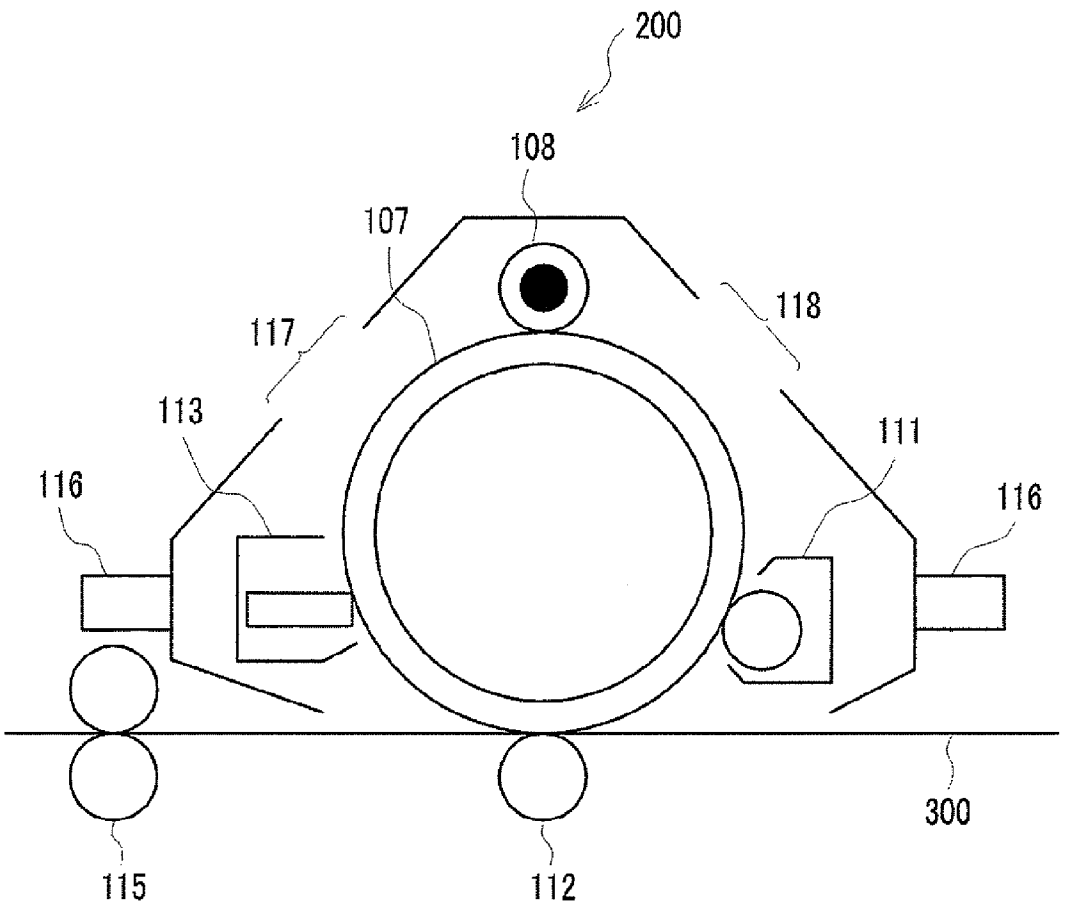
FIG. 3 is a diagram schematically illustrating the configuration of a process cartridge according to the exemplary embodiment of the invention.

FIG. 3 is a configurational diagram schematically illustrating a suitable example of the process cartridge containing the developer according to this exemplary embodiment. In the process cartridge 200, a charging roller 108, a developing device 111, a photosensitive member cleaning device (cleaning unit) 113, an exposure opening 118, and an erasing exposure opening 117 are combined with a photosensitive member 107 to form a body by the use of an attachment rail 116.

The process cartridge 200 is detachable from an image forming apparatus body including a transfer device 112, a fixing device 115, and other constituent parts not shown and forms the image forming apparatus along with the image forming apparatus body. Reference numeral 300 represents a recording sheet.

The process cartridge 200 shown in FIG. 3 includes the photosensitive member 107, the charging device 108, the developing device 111, the cleaning device 113, the exposure opening 118, and the erasing exposure opening 117, but these elements may be selectively combined. The process cartridge according to this exemplary embodiment may include at least one element selected from the group consisting of the photosensitive member 107, the charging device 108, and the cleaning device (the cleaning unit) 113, the exposure opening 118, and the erasing exposure opening 117, in addition to the developing device 111.

A toner cartridge will be described below.

The toner cartridge is detachably mounted on an image forming apparatus and contains at least a toner to be supplied to a developing unit disposed in the image forming apparatus. Here, the above-mentioned toner according to this exemplary embodiment is used as the toner. The toner cartridge has only to contain at least a toner and may contain, for example, a developer depending on a mechanism of the image forming apparatus.

The image forming apparatus shown in FIG. 2 is an image forming apparatus having the configuration in which the toner cartridges 8Y, 8M, 8C, and 8K are detachable therefrom. The developing devices 4Y, 4M, 4C, and 4K are connected to the toner cartridges corresponding to the developing devices (colors) via toner supply pipes not shown. When the developer contained in each toner cartridge becomes less, the corresponding toner cartridge is replaced.

EXAMPLES

This exemplary embodiment will be described below in more detail with reference to examples and comparative examples, but this exemplary embodiment is not limited to the examples. "part" and "%" are based on mass, as long as they are not differently defined.

Preparation of Binder Resin 1-1

Oxymethylene(1.1)-2,2-bis(4-hydroxyphenyl)propane: 40 parts

Ethylene glycol: 10 parts

Terephthalic acid: 45 parts

Fumaric acid: 5 parts

These materials are input to a ring-bottomed flask including a stirrer, a nitrogen introduction tube, a temperature sensor, and a rectifying column and the temperature of the flask is raised to 200° C. by the use of a mantle heater. Then, the materials are stirred while introducing nitrogen gas from the gas introduction tube to maintain the inside of the flask in the atmosphere of inert gas. Thereafter, 0.05 parts of dibutyltin oxide is added to 100 parts of the material mixture and the reactants are made to react with each other for 12 hours while maintaining the temperature at 200° C., whereby Binder Resin 1-1 is obtained.

Tg of the obtained resin is 44° C. when it is measured by the DSC.

Preparation of Binder Resin 1-2

Binder Resin 1-2 is obtained using the same composition and preparation method as Binder Resin 1-1, except that oxymethylene(1.1)-2,2-bis(4-hydroxyphenyl)propane is replaced with polyoxyethylene(1.2)-2,2-bis(4-hydroxyphenyl)propane. Tg of the obtained resin is 44° C. when it is measured by the DSC.

Preparation of Binder Resin 1-3

Binder Resin 1-3 is obtained using the same composition and preparation method as Binder Resin 1-1, except that oxymethylene(1.1)-2,2-bis(4-hydroxyphenyl)propane is replaced with polyoxypropylene(1.3)-2,2-bis(4-hydroxyphenyl)propane. Tg of the obtained resin is 44° C. when it is measured by the DSC.

Preparation of Binder Resin 1-4

Binder Resin 1-4 is obtained using the same composition and preparation method as Binder Resin 1-1, except that oxymethylene(1.1)-2,2-bis(4-hydroxyphenyl)propane is replaced with polyoxybutylene(1.4)-2,2-bis(4-hydroxyphenyl)propane. Tg of the obtained resin is 44° C. when it is measured by the DSC.

Preparation of Binder Resin 1-5

Binder Resin 1-5 is obtained using the same composition and preparation method as Binder Resin 1-1, except that oxymethylne(1.1)-2,2-bis(4-hydroxyphenyl)propane is replaced with polyoxypentene(1.5)-2,2-bis(4-hydroxyphenyl)propane. Tg of the obtained resin is 44° C. when it is measured by the DSC.

Preparation of Binder Resin 2

Binder Resin 2 is obtained using the same composition and preparation method as Binder Resin 1-3, except that the content of terephthalic acid is changed to 35 parts and the content of fumaric acid is changed to 15 parts. Tg of the obtained resin is 34° C. when it is measured by the DSC.

Preparation of Binder Resin 3

Binder Resin 3 is obtained using the same composition and preparation method as Binder Resin 1-3, except that the content of terephthalic acid is changed to 36 parts and the content of fumaric acid is changed to 14 parts. Tg of the obtained resin is 35° C. when it is measured by the DSC.

Preparation of Binder Resin 4

Binder Resin 4 is obtained using the same composition and preparation method as Binder Resin 1-3, except that the content of terephthalic acid is changed to 37 parts and the content of fumaric acid is changed to 13 parts. Tg of the obtained resin is 36° C. when it is measured by the DSC.

Preparation of Binder Resin 5

Binder Resin 5 is obtained using the same composition and preparation method as Binder Resin 1-3, except that the content of terephthalic acid is changed to 41 parts and the content of fumaric acid is changed to 9 parts. Tg of the obtained resin is 40° C. when it is measured by the DSC.

Preparation of Binder Resin 6

Binder Resin 6 is obtained using the same composition and preparation method as Binder Resin 1-3, except that the content of terephthalic acid is changed to 49 parts and the content of fumaric acid is changed to 1 part. Tg of the obtained resin is 48° C. when it is measured by the DSC.

Preparation of Binder Resin 7

Binder Resin 7 is obtained using the same composition and preparation method as Binder Resin 1-3, except that the content of polyoxypropylene(1.3)-2,2-bis(4-hydroxyphenyl) propane is changed to 41 parts and the content of ethylene glycol is changed to 9 parts. Tg of the obtained resin is 51° C. when it is measured by the DSC.

Production of Toner 1

Binder Resin 1-3: 1760 parts

Release agent (polypropylene: Mitsui HI-WAX NP055, made by Mitsui Chemicals Inc.): 100 parts C.I. Pigment Red 122 (Supermagenta, made by DIC Inc.) 99.55 parts C.I. Pigment Yellow 180 (Novoperm Yellow P-H9, made by Clariant International Inc.): 0.05 parts 40 nm silica (OC-50, made by NipponAerosil Co., Ltd.): 20 parts Rosin (HARTALL RX, made by Harima Chemicals Inc.): 20 parts These components are blended with a 75 L Henschel mixer and are kneaded under the following conditions by the use of a continuous kneader (two-axis extruder) having the screw structure shown in FIG. 1.

The rotation rate of the screw is 500 rpm.

Set Temperature of feed part (blocks 12A and 12B): 20° C.

Kneading set temperature of kneading part 1 (blocks 12C to 12E): 120° C.

Kneading set temperature of kneading part 2 (blocks 12F to 12J): 135° C.

Amount of aqueous medium (distilled water) added: 1.5 parts with respect to 100 parts of source materials The temperature of the kneaded material in the discharge port (the discharge port 18) at this time is 125° C.

The inside is rapidly cooled through the use of a mill roll using −5° C. brine and a slab insertion type cooling belt using 2° C. cold water and the kneaded material is ground with a hammer mill after the cooling. The rapid cooling rate is checked while changing the speed of the cooling belt and the average temperature-falling rate is 10° C./sec.

Thereafter, the grounded material is pulverized with a pulverizer (AFG400) having a coarse grain classifier built therein to obtain pulverized particles. Thereafter, the pulverized particles are classified by the use of an inertial classifier to remove fine grains and coarse grains, whereby Toner Particle 1 is obtained.

The shape factor SF1 of Toner Particle 1 is 150.

1.0 part of 30 nm silica (which is obtained by treating MOX (made by Nippon Aerosil Co., Ltd.), with isobutyltrimethoxysilane) and 0.5 part of 16 nm silica (R972 made by Nippon Aerosil Co., Ltd.) are added to 100 parts of Toner Particle 1 and the resultant is mixed by the use of a Henschel mixer for 3 minutes (an edge speed of a rotating blade of 22 m/s), whereby Toner 1 is obtained. The shape factor SF1 of Toner 1 is the same as Toner Particle 1.

Toner 1 is dissolved in toluene, insoluble is extracted, and then it is confirmed that the ratio (PR122/PY180) of the amount of C.I. Pigment Red 122 and the amount of C.I. Pigment Yellow 180 is 1991 through IR and fluorescent X-ray analysis and NMR analysis.

Production of Toner 2

Toner 2 is obtained in the same way as producing Toner 1, except that Binder Resin 1-4 is used instead of Binder Resin 1-3.

Production of Toner 3

Toner 3 is obtained in the same way as producing Toner 1, except that Binder Resin 1-2 is used instead of Binder Resin 1-3.

Production of Toner 4

Toner 4 is obtained in the same way as producing Toner 1, except that the content of C.I. Pigment Yellow 180 is changed to 0.01016 part.

Production of Toner 5

Toner 5 is obtained in the same way as producing Toner 1, except that the content of C.I. Pigment Red 122 is changed to 100 parts and the content of C.I. Pigment Yellow 180 is changed to 1 part.

Production of Toner 6

Toner 6 is obtained in the same way as producing Toner 1, except that the content of C.I. Pigment Yellow 180 is changed to 0.195 part.

Production of Toner 7

Toner 7 is obtained in the same way as producing Toner 1, except that the content of C.I. Pigment Yellow 180 is changed to 0.02 part.

Production of Toner 8

Toner 8 is obtained in the same way as producing Toner 1, except that the content of C.I. Pigment Yellow 180 is changed to 0.21 part.

Production of Toner 9

Toner 9 is obtained in the same way as producing Toner 1, except that the content of C.I. Pigment Yellow 180 is changed to 0.019 part.

Production of Toners 10 to 17

Toners 10 to 17 are obtained in the same way as producing Toner 1, except that the pulverizing conditions of the pulverizer and the classifying conditions of the inertial classifier are adjusted to change the volume-average particle diameter and the shape factor SF1.

Production of Toner 18

Toner 18 is obtained in the same way as producing Toner 1, except that polyethylene (Sanwax 151P, made by Sanyo Chemical Industries Ltd.) is used as the release agent instead of polypropylene.

Production of Toner 19

Toner 19 is obtained in the same way as producing Toner 1, except that Fischer-Tropsch wax (FNP-0092, made by Nippon Seiro Co., Ltd.) is used as the release agent instead of polypropylene.

Production of Toner 20

Toner 20 is obtained in the same way as producing Toner 1, except that polyester (WEP5, made by Nippon Oil & Fats Co., Ltd.) is used as the release agent instead of polypropylene.

Production of Toner 21

Toner 21 is obtained in the same way as producing Toner 1, except that carnauba wax (Carnauba wax I, made by Katoyoko K.K.) is used as the release agent instead of polypropylene.

Production of Toner 22

Toner 22 is obtained in the same way as producing Toner 1, except that Binder Resin 2 is used instead of Binder Resin 1-3.

Production of Toner 23

Toner 23 is obtained in the same way as producing Toner 1, except that Binder Resin 3 is used instead of Binder Resin 1-3.

Production of Toner 24

Toner 24 is obtained in the same way as producing Toner 1, except that Binder Resin 4 is used instead of Binder Resin 1-3.

Production of Toner 25

Toner 25 is obtained in the same way as producing Toner 1, except that Binder Resin 5 is used instead of Binder Resin 1-3.

Production of Toner 26

Toner 26 is obtained in the same way as producing Toner 1, except that Binder Resin 6 is used instead of Binder Resin 1-3.

Production of Toner 27

Toner 27 is obtained in the same way as producing Toner 1, except that Binder Resin 7 is used instead of Binder Resin 1-3.

Production of Toner 28

Toner 28 is obtained in the same way as producing Toner 1, except that Binder Resin 1-5 is used instead of Binder Resin 1-3.

Production of Toner 29

Toner 29 is obtained in the same way as producing Toner 1, except that Binder Resin 1-1 is used instead of Binder Resin 1-3.

Production of Toner 30

Toner 30 is obtained in the same way as producing Toner 1, except that the content of C.I. Pigment Red 122 is changed to 98.5 parts and the content of C.I. Pigment Yellow 180 is changed to 1.15 parts.

Production of Toner 31

Toner 31 is obtained in the same way as producing Toner 1, except that the content of C.I. Pigment Red 122 is changed to 99.1 parts and the content of C.I. Pigment Yellow 180 is changed to 0.009 part.

Production of Toner 32

Toner 32 is obtained in the same way as producing Toner 1, except that R238 (Permanent Carmine 3810, made by Sanyo Color Works Ltd.) is used instead of C.I. Pigment Red 122.

Production of Toner 33

Toner 33 is obtained in the same way as producing Toner 1, except that C.I. Pigment Yellow 74 (PY74: Hansa Yellow 5GX01, made by Clariant International Inc.) is used instead of C.I. Pigment Yellow 180.

Production of Toner 34

Toner 34 is obtained in the same way as producing Toner 1, except that R238 is used instead of C.I. Pigment Red 122 and PY74 is used instead of C.I. Pigment Yellow 180.

Production of Yellow Toner

Yellow toner is obtained in the same way as producing Toner 1, except that 100 parts of azo pigment (Brilliant Yellow GX01, made by Clariant International Inc.) are used as a colorant.

Production of Carrier 1000 parts of Mn—Mg ferrite (made by Powdertech Co., Ltd., with an average particle diameter of 50 μm) are input to a kneader, a solution in which 150 parts of styrene-methyl methacrylate-acrylate copolymer (with a polymerization ratio of 39:60:1 (mole ratio), Tg of 100° C., and a weight-average molecular weight of 73,000, made by Soken Chemical & Engineering Co., Ltd.) are dissolved in 700 parts of toluene is added thereto, the resultant is mixed at 25° C. for 20 minutes, the mixture is heated to 70° C. and is then depressurized and dried, and the resultant is extracted, whereby a coated carrier is obtained. The coated carrier is sieved with a mesh of 75 μm apertures to remove coarse grains, whereby Carrier 1 is obtained.

Production of Developer

Carrier 1 and Toners 1 to 34 or Yellow Toner are input to a V blender at a mass ratio of 95:5 and are stirred for 20 minutes, whereby Magenta Developers 1 to 34 and Yellow Developer are obtained.

Evaluation

ApeosPort-C4300, made by Fuji Xerox Co., Ltd., is filled with Magenta Developers 1 to 34 and Yellow Developer. An image is formed on a sheet of coated paper (127.9 g/m$^2$) by the use of a chart of Japan Color 2007 (JCS2007) for sheet-fed printing at 28° C. at 95% RH. The image quality after 100 repeated copies and the initial image quality (at the first copy) are compared with each other, whereby the red reproducibility in high humidity is checked with naked eyes. The red reproducibility in high humidity is evaluated on the basis of the following criterion.

Criterion for Determination of Red Reproducibility

A: Level equivalent to the initial image quality

B: Level slightly different from initial image quality but not giving unpleasant feeling C: Level different from initial image quality but not giving unpleasant feeling D: Level clearly different from initial image quality but giving unpleasant feeling The results are shown in Table 1 and Table 2, along with the values of m and n in the repeating unit obtained from Bisphenol A alkylene oxide expressed by Chemical Formula 1, the content of C.I. Pigment Yellow 180 (PY180), the content of C.I. Pigment Red 122 (PR122), the mass ratio (PR122/PY180) of the C.I. Pigment Red 122 and the C.I. Pigment Yellow 180, the volume-average particle diameter of toner, SF1 of toner, the type of the release agent, the type of the binder resin, and the glass transition temperature of toner.

TABLE 1

| | Toner | Values of m & n in formula 1 | Content of PR122 (parts) | Content of PY180 (parts) | PR122/ PY180 ratio | Volume-average particle diameter μm | SF1 | Release agent | Binder resin | Glass transition temperature | Red reproducibility |
|---|---|---|---|---|---|---|---|---|---|---|---|
| Ex. 1 | 1 | 3 | 99.55 | 0.05 | 1991 | 10 | 150 | polypropylene | 1-3 | 44° C. | A |
| Ex. 2 | 2 | 4 | 99.55 | 0.05 | 1991 | 10 | 150 | polypropylene | 1-4 | 44° C. | A |
| Ex. 3 | 3 | 2 | 99.55 | 0.05 | 1991 | 10 | 150 | polypropylene | 1-2 | 44° C. | A |
| Ex. 4 | 4 | 3 | 99.55 | 0.01016 | 9798 | 10 | 150 | polypropylene | 1-3 | 44° C. | C |
| Ex. 5 | 5 | 3 | 100 | 1 | 100 | 10 | 150 | polypropylene | 1-3 | 44° C. | C |
| Ex. 6 | 6 | 3 | 99.55 | 0.195 | 511 | 10 | 150 | polypropylene | 1-3 | 44° C. | A |
| Ex. 7 | 7 | 3 | 99.55 | 0.02 | 4978 | 10 | 150 | polypropylene | 1-3 | 44° C. | A |
| Ex. 8 | 8 | 3 | 99.55 | 0.21 | 474 | 10 | 150 | polypropylene | 1-3 | 44° C. | B |
| Ex. 9 | 9 | 3 | 99.55 | 0.019 | 5239 | 10 | 150 | polypropylene | 1-3 | 44° C. | B |
| Ex. 10 | 10 | 3 | 99.55 | 0.05 | 1991 | 7 | 150 | polypropylene | 1-3 | 44° C. | B |
| Ex. 11 | 11 | 3 | 99.55 | 0.05 | 1991 | 8 | 150 | polypropylene | 1-3 | 44° C. | A |
| Ex. 12 | 12 | 3 | 99.55 | 0.05 | 1991 | 14.5 | 150 | polypropylene | 1-3 | 44° C. | A |
| Ex. 13 | 13 | 3 | 99.55 | 0.05 | 1991 | 16 | 150 | polypropylene | 1-3 | 44° C. | B |
| Ex. 14 | 14 | 3 | 99.55 | 0.05 | 1991 | 10 | 162 | polypropylene | 1-3 | 44° C. | B |
| Ex. 15 | 15 | 3 | 99.55 | 0.05 | 1991 | 10 | 159 | polypropylene | 1-3 | 44° C. | A |
| Ex. 16 | 16 | 3 | 99.55 | 0.05 | 1991 | 10 | 141 | polypropylene | 1-3 | 44° C. | A |
| Ex. 17 | 17 | 3 | 99.55 | 0.05 | 1991 | 10 | 139 | polypropylene | 1-3 | 44° C. | B |
| Ex. 18 | 18 | 3 | 99.55 | 0.05 | 1991 | 10 | 150 | polyethylene | 1-3 | 44° C. | A |
| Ex. 19 | 19 | 3 | 99.55 | 0.05 | 1991 | 10 | 150 | Fischer-Tropsch | 1-3 | 44° C. | A |

TABLE 2

| | Toner | Values of m & n in formula 1 | Content of PR122 (parts) | Content of PY180 (parts) | PR122/ PY180 ratio | Volume-average particle diameter μm | SF1 | Release agent | Binder resin | Glass transition temperature | Red reproducibility |
|---|---|---|---|---|---|---|---|---|---|---|---|
| Ex. 20 | 20 | 3 | 99.55 | 0.05 | 1991 | 10 | 150 | polyester | 1-3 | 44° C. | B |
| Ex. 21 | 21 | 3 | 99.55 | 0.05 | 1991 | 10 | 150 | carnauba | 1-3 | 44° C. | B |
| Ex. 22 | 22 | 3 | 99.55 | 0.05 | 1991 | 10 | 150 | polypropylene | 2 | 34° C. | B |
| Ex. 23 | 23 | 3 | 99.55 | 0.05 | 1991 | 10 | 150 | polypropylene | 3 | 35° C. | A |
| Ex. 24 | 24 | 3 | 99.55 | 0.05 | 1991 | 10 | 150 | polypropylene | 4 | 36° C. | A |
| Ex. 25 | 25 | 3 | 99.55 | 0.05 | 1991 | 10 | 150 | polypropylene | 5 | 40° C. | A |
| Ex. 26 | 26 | 3 | 99.55 | 0.05 | 1991 | 10 | 150 | polypropylene | 6 | 48° C. | A |
| Ex. 27 | 27 | 3 | 99.55 | 0.05 | 1991 | 10 | 150 | polypropylene | 7 | 51° C. | B |
| Com. Ex. 1 | 28 | 5 | 99.55 | 0.05 | 1991 | 10 | 150 | polypropylene | 1-5 | 44° C. | D |
| Com. Ex. 2 | 29 | 1 | 99.55 | 0.05 | 1991 | 10 | 150 | polypropylene | 1-1 | 44° C. | D |
| Com. Ex. 3 | 30 | 3 | 98.5 | 1.15 | 86 | 10 | 150 | polypropylene | 1-3 | 44° C. | D |
| Com. Ex. 4 | 31 | 3 | 99.1 | 0.009 | 11011 | 10 | 150 | polypropylene | 1-3 | 44° C. | D |
| Com. Ex. 5 | 32 | 3 | R238: 99.55 | 0.05 | 1991 | 10 | 150 | polypropylene | 1-3 | 44° C. | D |
| Com. Ex. 6 | 33 | 3 | 99.55 | PY74: 0.05 | 1991 | 10 | 150 | polypropylene | 1-3 | 44° C. | D |
| Com. Ex. 7 | 34 | 3 | R238: 99.55 | PY74: 0.05 | 1991 | 10 | 150 | polypropylene | 1-3 | 44° C. | D |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A magenta toner comprising toner particles having a colorant and a binder resin, wherein the colorant contains C.I. Pigment Red 122 and C.I. Pigment Yellow 180, and a mass ratio of the C.I. Pigment Red 122 and the C.I. Pigment Yellow 180 is in the range of 99:1 to 10000:1, the binder resin contains a polyester resin, and a polyester resin containing a repeating unit obtained from a Bisphenol A alkylene oxide adduct expressed by the following chemical formula 1 is used as the polyester resin:

Chemical Formula 1

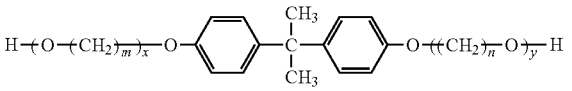

wherein m and n independently represent an integer of from 2 to 4, and x and y independently represent a positive number.

2. The magenta toner according to claim 1, wherein a volume-average particle diameter of the toner particles is in the range of from about 8 μm to about 15 μm.

3. The magenta toner according to claim 1, wherein a shape factor SF1 of the toner particles is in the range of from about 140 to about 160.

4. The magenta toner according to claim 1, wherein the toner particles contain a hydrocarbon wax as a release agent.

5. The magenta toner according to claim 4, wherein the hydrocarbon wax is selected from paraffin waxes, microcrystalline waxes, Fischer-Tropsch waxes, petroleum waxes, and modified products thereof.

6. The magenta toner according to claim 1, wherein a glass transition temperature of the magenta toner is in the range of from about 35° C. to about 50° C.

7. The magenta toner according to claim 1, wherein the mass ratio of the C.I. Pigment Red 122 and the C.I. Pigment Yellow 180 is in the range of 500:1 to 5000:1.

8. The magenta toner according to claim 1, wherein the polyester resin has a ratio of the repeating unit obtained from the Bisphenol A alkylene oxide adduct to a repeating unit obtained from overall diol components, which is equal to or more than 80 mol %.

9. The magenta toner according to claim 1, wherein the toner particles are formed by kneading a toner-forming material including the colorant and the binder resin to form a kneaded material and pulverizing the kneaded material.

10. An electrostatic latent image developer comprising the magenta toner according to claim 1.

11. The electrostatic latent image developer according to claim 10, wherein a glass transition temperature of the magenta toner is in the range of from about 35° C. to about 50° C.

12. The electrostatic latent image developer according to claim 10, wherein the colorant of the magenta toner contains the C.I. Pigment Red 122 and the C.I. Pigment Yellow 180 in the range of mass ratio of 500:1 to 5000:1.

13. A process cartridge for an image forming apparatus, comprising:

an image holding member; and a developing unit that develops an electrostatic latent image formed on the surface of the image holding member with a developer to form a toner image, wherein the developer is the electrostatic latent image developer according to claim 10.

14. The process cartridge for an image forming apparatus according to claim 13, wherein the colorant of the magenta toner contains the C.I. Pigment Red 122 and the C.I. Pigment Yellow 180 in the range of mass ratio of 500:1 to 5000:1.

15. An image forming apparatus comprising:

an image holding member;

a charging unit that charges the surface of the image holding member;

a latent image forming unit that forms an electrostatic latent image on the surface of the image holding member;

a developing unit that develops the electrostatic latent image formed on the surface of the image holding member with a developer to form a toner image; and a transfer unit that transfers the developed toner image to a transfer medium, wherein the developer is the electrostatic latent image developer according to claim 10.

16. The image forming apparatus according to claim 15, wherein the colorant of the magenta toner contains the C.I. Pigment Red 122 and the C.I. Pigment Yellow 180 in the range of mass ratio of 500:1 to 5000:1.

17. An image forming method comprising:

charging the surface of an image holding member;

forming an electrostatic latent image on the surface of the image holding member;

developing the electrostatic latent image formed on the surface of the image holding member with a developer to form a toner image; and transferring the developed toner image to a transfer medium, wherein the developer is the electrostatic latent image developer according to claim 10.

18. The image forming method according to claim 17, wherein the colorant of the magenta toner contains the C.I. Pigment Red 122 and the C.I. Pigment Yellow 180 in the range of mass ratio of 500:1 to 5000:1.

19. A toner cartridge comprising a toner containing chamber, wherein the toner containing chamber contains the magenta toner according to claim 1.

* * * * *